US008147354B2

(12) United States Patent
Hartwell et al.

(10) Patent No.: US 8,147,354 B2
(45) Date of Patent: Apr. 3, 2012

(54) GOLF CLUB HEAD WITH MULTI-COMPONENT CONSTRUCTION

(75) Inventors: Bradford Hughes Hartwell, Carlsbad, CA (US); Michael T. McDonnell, Carlsbad, CA (US); Ryan L. Roach, Carlsbad, CA (US); Peter L. Soracco, Carlsbad, CA (US)

(73) Assignee: Cobra Golf Incorporated, Carlsbad, CA (US)

( * ) Notice: Subject to any disclaimer, the term of this patent is extended or adjusted under 35 U.S.C. 154(b) by 183 days.

(21) Appl. No.: 12/643,154

(22) Filed: Dec. 21, 2009

(65) Prior Publication Data

US 2011/0152003 A1 Jun. 23, 2011

(51) Int. Cl.
*A63B 53/04* (2006.01)

(52) U.S. Cl. ..... 473/345; 473/344; 473/349

(58) Field of Classification Search ..... 473/324, 473/344, 345, 347, 349
See application file for complete search history.

(56) References Cited

U.S. PATENT DOCUMENTS 5,328,176 A 7/1994 Lo
6,354,963 B1 3/2002 Kodama et al.
6,602,149 B1 8/2003 Jacobson
6,648,774 B1 11/2003 Lee
6,739,982 B2 5/2004 Murphy et al.
6,860,823 B2 3/2005 Lee
7,063,629 B2 6/2006 Nakahara et al.
7,128,664 B2 10/2006 Onoda et al.
7,217,199 B2 * 5/2007 Nakahara et al. ..... 473/329
7,252,599 B2 * 8/2007 Hasegawa ..... 473/329
7,297,072 B2 11/2007 Meyer et al.
7,303,487 B2 * 12/2007 Kumamoto ..... 473/345
7,371,191 B2 * 5/2008 Sugimoto ..... 473/345
8,007,371 B2 * 8/2011 Breier et al. ..... 473/342
2004/0116207 A1 6/2004 De Shiell et al.
2004/0116208 A1 6/2004 De Shiell et al.
2004/0224790 A1 11/2004 Lu
2008/0102978 A1 * 5/2008 Burnett et al. ..... 473/324
2008/0293510 A1 * 11/2008 Yamamoto ..... 473/308
2009/0105010 A1 * 4/2009 De La Cruz et al. ..... 473/345
2011/0021282 A1 * 1/2011 Sander ..... 473/288
2011/0207547 A1 * 8/2011 Sander et al. ..... 473/307

* cited by examiner

*Primary Examiner* — Stephen L. Blau

(74) *Attorney, Agent, or Firm* — Mark S. Leonardo; Brown Rudnick LLP

(57) ABSTRACT

A golf club head with multi-component construction. The golf club head includes a hollow body that is created from components constructed of different materials so that the weight distribution may be optimized.

6 Claims, 6 Drawing Sheets

GOLF CLUB HEAD WITH MULTI-COMPONENT CONSTRUCTION

FIELD OF THE INVENTION

This invention generally relates to golf club heads, and more specifically to the construction of hollow golf club heads.

BACKGROUND OF THE INVENTION

Golf club heads come in many different forms and makes, such as wood- or metalwood-type (including drivers and fairway woods), iron-type (including wedge-type club heads), utility- or specialty-type, and putter-type club heads. Each of these types has a prescribed function and make-up. The present invention primarily relates to hollow golf club heads, which may be any of those types, but are primarily wood-type and utility-type golf club heads.

The design and manufacture of wood-type golf clubs requires careful attention to club head construction. Among the many factors that must be considered are material selection, material treatment, structural integrity, and overall geometric design. Exemplary geometric design considerations include loft, lie, face angle, horizontal face bulge, vertical face roll, face size, sole curvature, center of gravity, moment of inertia, and overall head weight. The interior design of the club head may be tailored to achieve particular characteristics, such as by including a hosel or other shaft attachment means, perimeter weighting on the face or body of the club head, and fillers within hollow club heads. Club heads typically are formed from stainless steel, aluminum, or titanium, and are cast, stamped as by forming sheet metal with pressure, forged, or formed by a combination of any two or more of these processes. Some club heads are formed from multiple pieces that are welded, bonded or otherwise joined together to form a hollow head. The multi-piece constructions facilitate access to the cavity formed within the club head, thereby permitting the attachment of various other components to the head such as internal weights and the club shaft. The cavity may remain empty, or may be partially or completely filled, such as with foam. An adhesive may be injected into the club head to provide the correct swing weight and to collect and retain any debris that may be in the club head. In addition, due to difficulties in manufacturing one-piece club heads to high dimensional tolerances, the use of multi-piece constructions allows the manufacture of a club head to a tight set of standards.

With golfers constantly searching for golf clubs that provide greater distance, particularly drivers, the golf industry has responded by providing golf clubs specifically designed with distance in mind. The head sizes of wood-type golf clubs have increased, which has allowed improved mass manipulation. The manipulation of mass allows the designer to alter attributes, such as the moment of inertia and the location of the center of gravity to provide a more forgiving golf club. In particular, providing a higher moment of inertia increases the ability of the golf club head to resist twisting on imperfect golf ball impacts. Additionally, the size of the golf club head allows more discretion in locating the center of gravity.

It is desirable to provide a golf club that provides for increased discretionary mass while providing desired performance and sound attributes.

SUMMARY OF THE INVENTION

The invention is directed to a golf club head with multi-component structure that provides desired performance characteristics and improved sound.

In an embodiment, a golf club head comprises a body member, a sole member and a crown member. The body member includes a crown portion, a sole portion, a face portion and a discontinuous skirt portion that defines a gap. The skirt portion extends aft-ward from at least one of the heel and toe ends of the main body. The sole member is coupled to the sole portion and the skirt portion so that a portion of the sole member is inserted into the gap to make the skirt continuous. The crown member is coupled to the body member and the sole member.

In another embodiment, a golf club head comprises a body member and a crown member. The body member includes a crown portion, a sole portion, a face portion and a skirt portion having a multi-faceted flange. The crown member is coupled to the skirt portion and the crown portion of the body member. The crown member includes a first flange and a second flange and the first flange and the second flanges are coupled to different facets of the multi-faceted flange.

In a further embodiment, a golf club head comprises a body member, a coupling member and a crown member. The body member includes a crown portion, a sole portion, a face portion and a skirt portion. The coupling member is coupled to the body member so that the coupling member is interposed between the body member and the crown member.

BRIEF DESCRIPTION OF THE DRAWINGS

In the accompanying drawings, which form a part of the specification and are to be read in conjunction therewith and in which like reference numerals are used to indicate like parts in the various views.

DETAILED DESCRIPTION OF THE PREFERRED EMBODIMENTS

The present invention is directed to a golf club head including a multi-component structure. Several embodiments of the present invention are described below. The embodiments incorporate structures that allow the multiple components to be attached with greater efficiency. For example, and as will be apparent from the description below, the attachment configuration allows the size of attachment flanges and resulting overlapping components to be reduced while providing the same or greater attachment strength. The structures and methods of the present invention also make it easier to control tolerances and to simplify cleaning procedures to remove excess material.

Other than in the operating examples, or unless otherwise expressly specified, all of the numerical ranges, amounts, values and percentages such as those for amounts of materials, moments of inertias, center of gravity locations, loft and draft angles, and others in the following portion of the specification may be read as if prefaced by the word "about" even though the term "about" may not expressly appear with the value, amount, or range. Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

Figure 1:
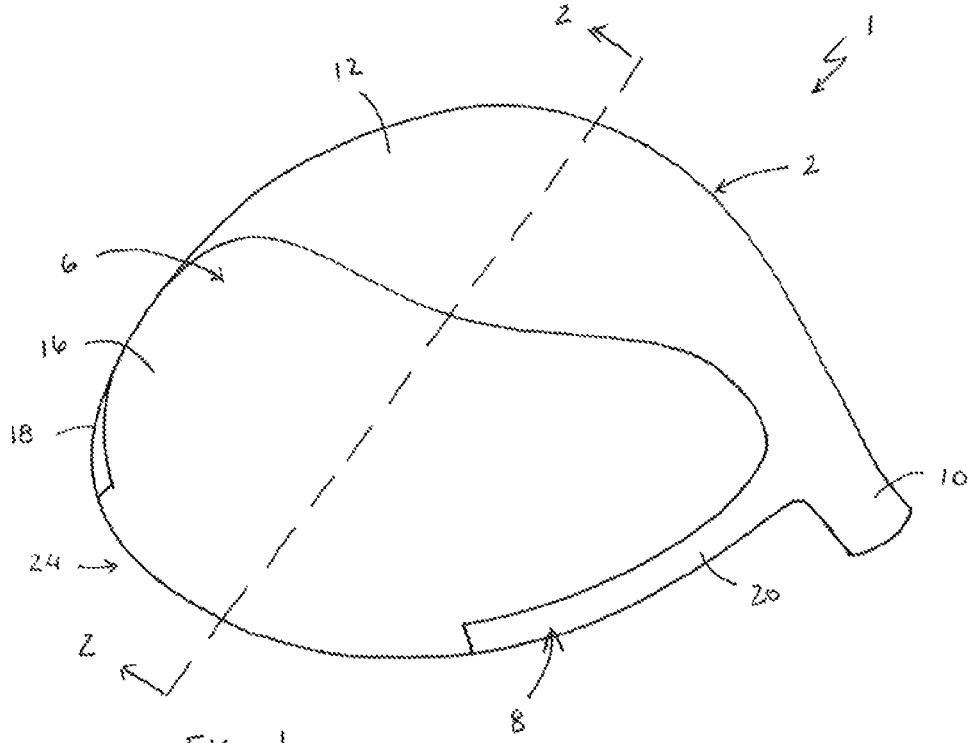
FIG. 1 is a perspective view of a golf club head of the present invention.
Figure 2:
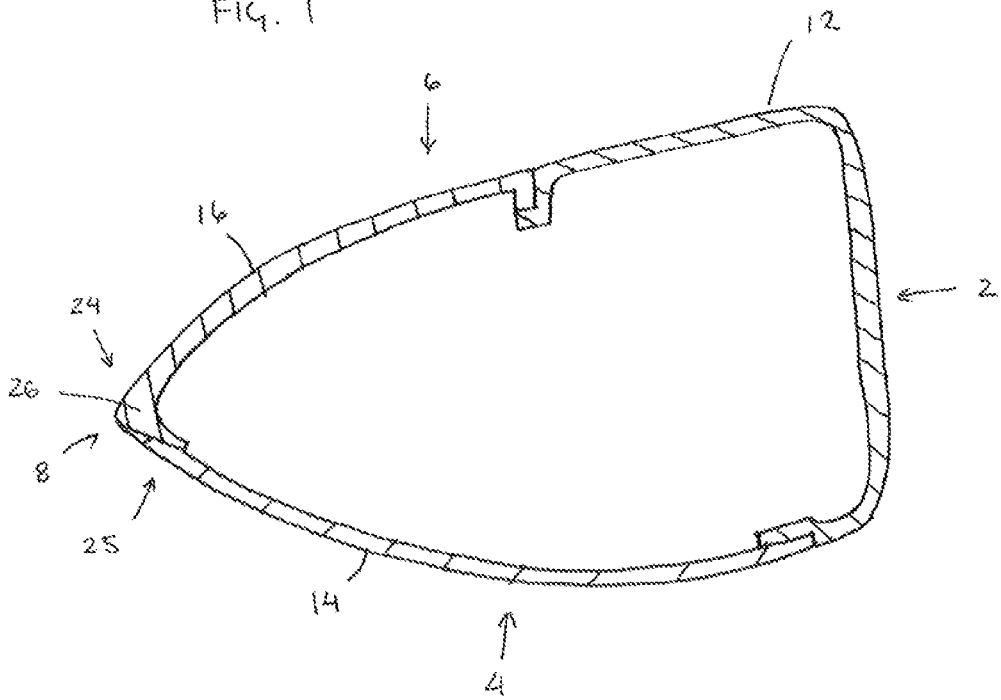
FIG. 2 is a cross-sectional view, taken along line 2-2, of the golf club head of FIG. 1.

Referring first to FIGS. 1 and 2, a golf club head including a construction of the present invention will be described. Golf club head 1 generally includes a ball-striking face 2, a crown 4, a sole 6, a skirt 8 that extends between crown 4 and sole 6, and a hosel 10. Golf club head 1 is generally constructed from a body member 12, a crown member 14, and a sole member 16. In the present embodiment, crown 4, sole 6 and skirt 8 each include a multi-material construction. In particular, a portion of crown 4 is constructed from body member 12 and another portion is constructed from crown member 14. A portion of sole 6 is constructed from body member 12 and another portion is constructed from sole member 16. Furthermore, a portion of skirt 8 is constructed from body member 12 and another portion of skirt 8 is constructed from sole member.

Body member 12 includes a crown portion 23 that forms a forward portion of crown 4, a sole portion 22 that forms a forward portion of sole 6, a skirt portion that forms either a discontinuous, or continuous, portion of skirt 8, and at least a peripheral portion of face 2 of golf club head 1. The crown portion is adjacent face 2 and extends aft-ward from face 2 and generally extends laterally from a toe side of the golf club head to a heel side of the golf club head and adjacent hosel 10. The fore-aft length of each of the crown portion and the sole portion of body member 12 may be any selected length, but is preferably in a range of about 0.100 inch to about 3.00 inches. The length of sole portion extending from face 2 may be selected so that a desired ground contact location, when the club is in an address position, is located on the sole portion. The length may also be selected so that the center of gravity of golf club head 1 is located vertically above the sole portion when the club is in an address position.

Sole portion 22 and skirt portion 18, 20 of body member 12 provide mounting features for attaching sole member 16 to body member 12. The mounting features may be any feature that provides structure for attaching a portion of sole member 16 to body member 12 such as an attachment flange or cavity. In the illustrated embodiment, body member 12 includes an attachment flange having portions with different configurations for attaching sole member. In particular, the attachment flange is configured so that sole member 16 is coupled to body member 12 with both a lap joint and a butt joint over portions of the attachment.

Crown portion 23 and skirt portion 18, 20 of body member 12 provide mounting features for attaching crown member 14 to body member 12. The mounting features may be any feature that provides structure for attaching a portion of crown member 14 to body member 12. As shown, a peripheral portion of crown member 14 overlaps and is coupled to body member 12 with a lap joint. Body member 12 and crown member 14 may be coupled using any attachment method suitable for the selected materials, such as adhesive bonding, ultrasonic welding, welding, brazing, soldering, etc.

In the illustrated embodiment, body member 12 includes a discontinuous skirt portion that includes a toe portion 18 and a heel portion 20 that do not meet at an aft portion of the golf club head. As a result, body member 12 includes a gap in the skirt portion that is located at an aft portion of body member 12. Skirt 8 in the completed golf club head 1, however, is continuous because a portion of sole member 16 is inserted into the gap and forms a portion of skirt 8. It should be appreciated that the skirt portions may be configured so that gap is located at any portion of skirt 8. For example, the gap may be located heel-ward, toe-ward or aft-ward on skirt 8.

Sole member 16 is coupled to sole portion 22 and the heel and toe skirt portions 18, 20 of body 12. An aft portion 24 of sole member 16 includes a flange 26 that provides an attachment feature for an aft portion of crown member 14 and additional reinforcement to that portion of the skirt. In the present embodiment, flange 26 extends between toe skirt portion 18 and heel skirt portion 20 of body member 12 to form a continuous skirt 8. It should be appreciated that an insert may be co-molded, bonded or inserted into flange 26 to provide additional strength and/or stiffness.

Figure 3:
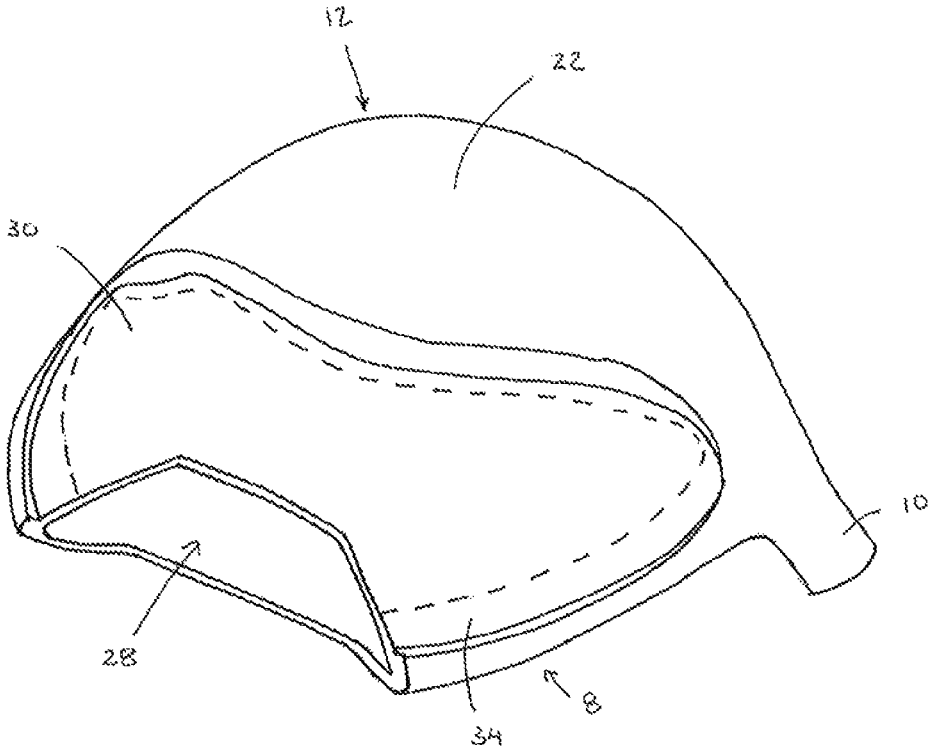
FIG. 3 is a perspective view of an embodiment of a body member of the golf club head of FIG. 1.
Figure 4:
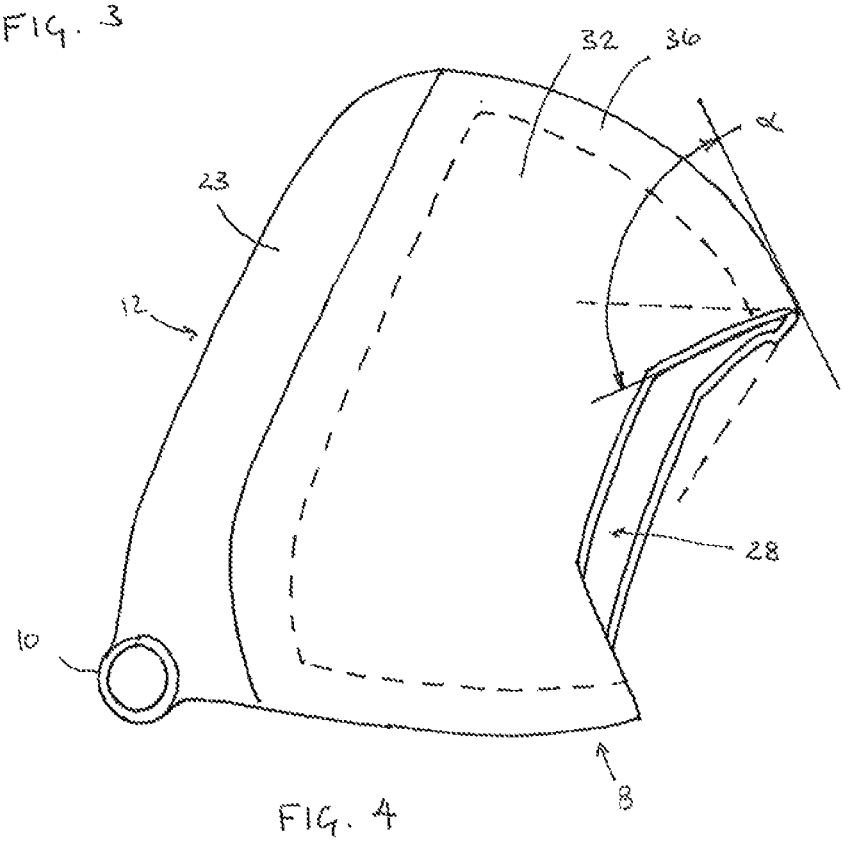
FIG. 4 is a top view of the body member of FIG. 3.

The structure of golf club head 1 provides manufacturing advantages over many previous multi-material constructions. Because only a portion of skirt 8 is formed from body member 12, the manufacturing method of golf club head 1 creates less waste. Referring to FIGS. 3 and 4, a method of constructing body member 12 and golf club head 1 will be described. Body member 12 is constructed as a monolithic structure. Preferably, body member 12 is constructed from a metallic material such as titanium, magnesium, steel, etc. such as by casting. Body member 12 may alternatively be constructed from a non-metallic material, such as a fiber reinforced plastic or a thermoset plastic by molding. Additionally, the construction allows the mass to be distributed more easily to manipulate the center of gravity and the moment of inertia of golf club head 1.

Body member 12 is initially constructed with a discontinuous skirt 8 and crown and sole portions with greater surface area than the final configuration. The crown and sole portions include a sole support 30 and a crown support 32, as shown by dotted line in FIGS. 3 and 4, which are recessed at the aft end of the body member to create a gap in the skirt such that the body member includes an aft opening 28. Sole support 30 and crown support 32 are formed during the initial formation of body member 12 and extend across body member 12 so that toe skirt portion 18 and heel skirt portion 20 are supported during the formation of body member 12. The support portions provide structural support to the skirt portions rather than forming them as cantilevered members relative to the remainder of body member 12. As a result, the support portions prevent dimensional changes of the body member and improve the flow of material during the forming process.

A portion of each of the sole support 30 and the crown support 32 extend to the extremities of toe skirt portions 18 and heel skirt portion 20. The angle of intersection of a respective extremity and support portion is predetermined to provide sufficient support to the skirt portion during manufacturing.

After body member 12 is formed sole support 30 and crown support 32 are removed and discarded. Sole support 30 and crown support 32 may be removed by any known method, such as milling, laser or plasma cutting, water jetting, etc. Sole support 30 and crown support 32 are cut so that a sole flange 34 and a crown flange 36 remain part of body member 12. The sizes of sole support 30 and crown support 32 are preferably minimized to reduce the amount of material that is discarded while providing adequate support to the heel and toe skirt portions to resist bending and twisting during manufacture. Preferably, each of the sole support 30 and the crown support 32 and a tangent to the skirt 8 intersect at an angle $\alpha$ of about 30° to about 120°, and more preferably the support and the skirt intersect at an angle of about 50° to about 100°, and more preferably at an angle of about 70° to about 90°.

The remaining portion of skirt 8 has an outer surface having a generally parabolic shape in cross-section having an apex that lies on an outer most edge of the club head. Preferably, the crown and sole flanges extend for a distance of between about 0.10 inch to about 0.5 inch inward from the outer most edge of the club head. The crown and sole portions may also include a step, or shoulder at an intermediate location.

After sole support 30 and crown support 32 are removed, sole member 16 is coupled to sole flange 34 of body member 12 to form a complete sole. Furthermore, the aft portion 24 of sole member 16 provides a structure for attachment of an aft portion 25 of crown member 14. In the present embodiment, aft portion 24 of sole member 16 includes a skirt structure and a flange 38 that completes the discontinuity in crown flange 36 and skirt 8. Crown member 14 is coupled to crown flange 36 and aft portion 24 of sole member 16 to complete crown 4 of golf club head 1.

Figure 5:
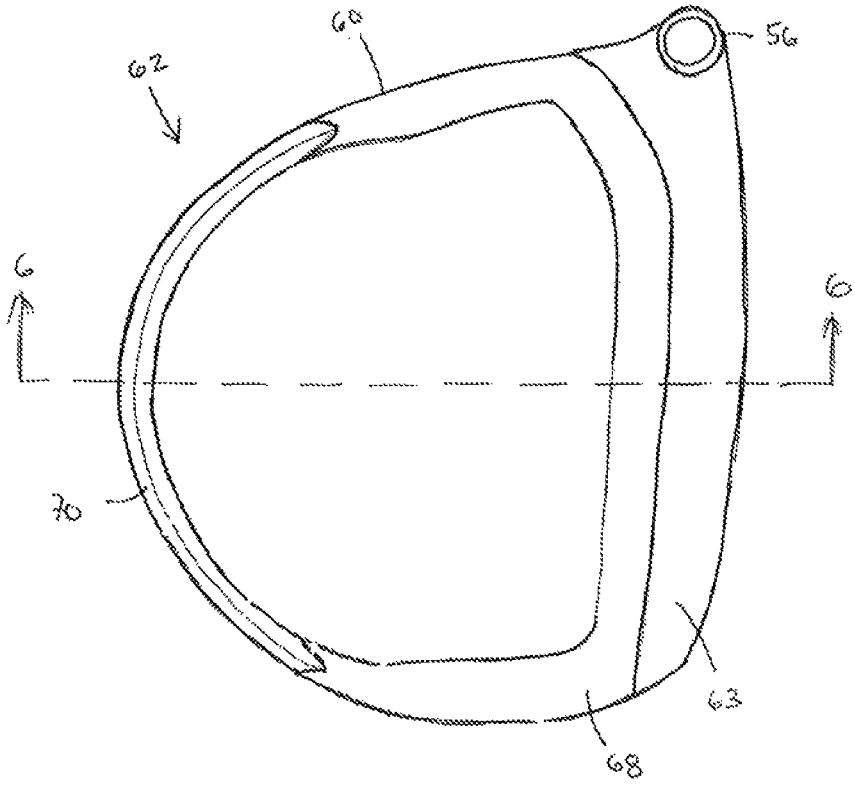
FIG. 5 is a top view of a body member included in another embodiment of a golf club head of the present invention.
Figure 6:
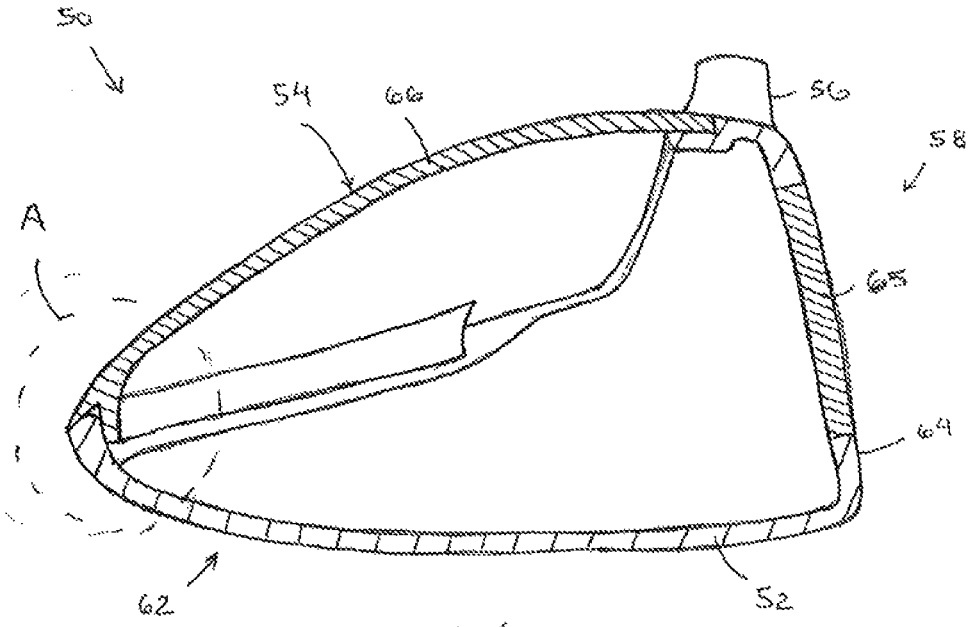
FIG. 6 is a cross-sectional view of a golf club head, taken along a plane generally corresponding to line 6-6 of FIG. 5.
Figure 7:
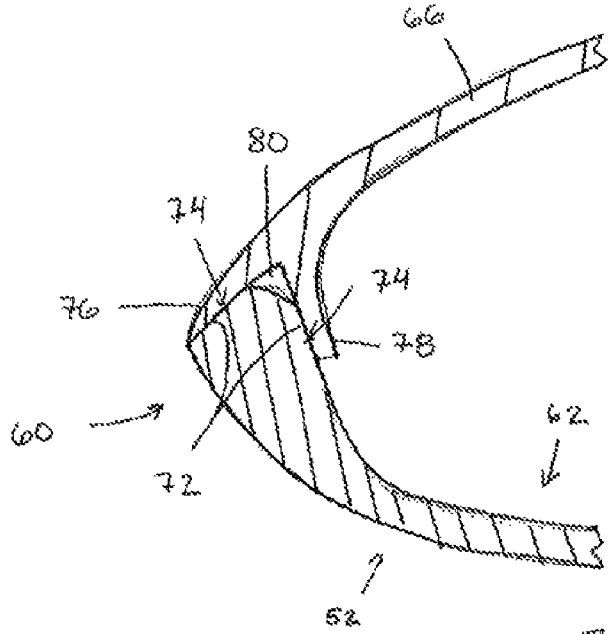
FIG. 7 is a partial cross-sectional view of detail A, shown in FIG. 5.

Referring to FIGS. 5-7, another embodiment including an alternative attachment structure for a sole and/or crown member will be described. Golf club head 50 generally includes a sole 52, a crown 54, a hosel 56, a ball-striking face 58 and a skirt 60. A body member 62 is constructed to include sole 52, a crown portion 63, hosel 56, a face portion 64 and skirt 60 as integral parts thereof. In particular, body member 62 is generally formed as a monolithic body, such as by casting a metallic material, and includes a crown opening that extends over a portion of crown 54 and a face opening that extends through ball-striking face 58. A face insert 65 is inserted into the face opening and is preferably suspended across the opening. Face insert 65 may provide any portion of ball-striking face 58 and may be constructed with a constant thickness or with portions having different thicknesses.

The crown opening is covered by a crown member 66 which is attached to body member 62. Preferably, crown member 66 is suspended across the crown opening and the perimeter of crown member 66 is attached to body member 62.

Crown member 66 is attached to attachment features that are formed on crown portion 63 and skirt 60 of body member 62. The attachment feature includes a first flange portion 68 and a second flange portion 70. First flange portion 68 includes a single faceted portion that provides a bonding surface for crown member 66 to crown portion 63 and a portion of skirt 60. Second flange portion 70 includes a multi-faceted portion that provides multiple bonding surfaces for crown member 66 on a portion of skirt 60. In the present embodiment, first flange portion 68 extends around a forward portion of the perimeter of the crown opening and second flange portion 70 extends around an aft portion of the perimeter of the crown opening.

First flange portion 68 provides a single faceted attachment feature that extends along a forward edge of the crown opening and along forward portions of skirt 60 on both the heel side and toe side of the golf club head. The first flange portion 68 is joined with crown member 66 by a single lap joint configuration. In particular, the corresponding portion of crown member 66 includes a single wall that overlaps and is coupled to first flange portion 68.

Second flange portion 70 provides a multi-faceted attachment feature that extends along an aft portion of skirt 60. By constructing a portion of skirt with a multi-faceted attachment feature, the mass of skirt 60 may be more efficiently located by creating a compact mass in the skirt while providing sufficient bonding surface area for the crown member. Additionally, the attachment feature allows more precise location of crown member 66 during manufacture because the interaction between the multi-faceted feature of skirt 60 and crown member 66 are self-locating.

An aft portion of crown member 66 includes a multi-faceted, or non-planar, attachment feature that complements the attachment feature of body member 62. As shown in detail in FIG. 7, an aft portion of crown member 66 includes a pair of attachment surfaces 72 that are angled relative to each other and that complement a pair of attachment surfaces 74 included on the skirt. In the present embodiment, attachment surfaces 72 of crown member 66 are formed on a pair of aft flanges 76, 78. A first aft flange 76 forms a portion of the outer surface of crown member 66 which has a continuous curved outer contour. A second flange 78 branches away from first aft flange 76 toward the internal cavity of the golf club head so that the two flanges are angled relative to each other and are configured for attachment to the multi-faceted skirt 60. It should also be appreciated that the flanges may create a continuous curved mounting surface that interfaces a curved mounting surface of the skirt.

The angle between flanges 76, 78 is selected to match the particular configuration of the skirt and the desired method of attachment. For example, the draft angle of the attachment surfaces of the skirt and the manufacturing tolerances of the crown member are considered. Additionally, the method of attaching the crown member is considered such as if, during attachment of the crown member, the entire periphery of the crown member contacts the body member at the same time or if a portion of the crown member is contacted and the remainder is rotated into position. In one method, the portion of the crown member closest to the face of the golf club is installed and the crown member is rotated so that the aft portion comes in contact with the body member However, the angle is generally between about 40° and about 140°, more preferably between about 60° and about 120°, and even more preferably between about 80° and about 100°.

Second flange 70 of skirt 60 and aft flanges 76, 78 are dimensioned so that a cavity 80 is formed between crown member 66 and skirt 60 after assembly of the golf club head. Cavity 80 is provided so that in embodiments utilizing adhesive to couple crown member 66 to body member 62, the adhesive may flow away from the contact surfaces of the flanges and the skirt and toward the intersection of aft flanges 76, 78. In other embodiments, a compressible gasket may be inserted into cavity 80 to provide a more forgiving fit during construction. In still further embodiments, the cavity may be omitted.

Figure 8:
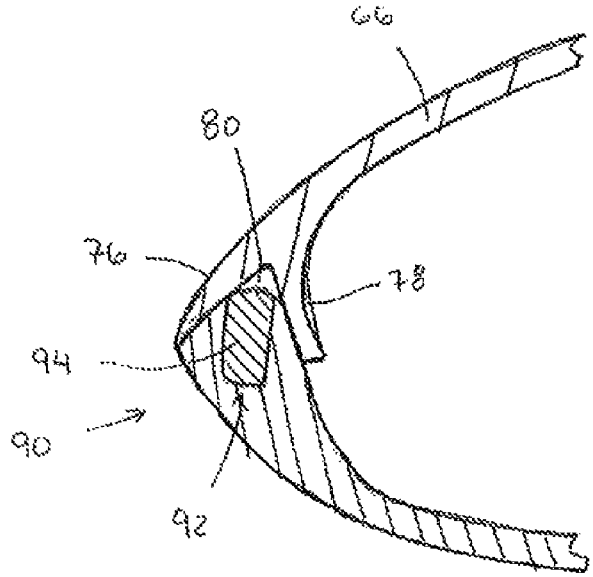
FIG. 8 is another partial cross-sectional view of detail A, shown in FIG. 5.

A detailed view of an alternative embodiment of the skirt is illustrated in FIG. 8. In the embodiment, the construction of the crown member is identical to that described above and the skirt has been modified. In particular, skirt 90 includes a cavity 92. Cavity 92 is configured to receive one or more inserts 94, but may be left empty if desired. In embodiments utilizing a plurality of inserts 94, the inserts may be provided with different masses to alter the weight distribution, such as by adding more weight heel-ward or toe-ward. Insert 94 may be constructed to do one or all of the following: to alter the mass of skirt 90, to provide damping or sound-tuning and/or to provide strength or stiffness to skirt 90. For example, insert 94 may be constructed from a material that has a density, stiffness, and/or strength that is different than the material of skirt 90 or insert 94 may be constructed from a material that has desired dampening properties. Insert 94 may be constructed from metallic materials such as aluminum, magnesium, titanium, tungsten, and alloys thereof, or it may be constructed from non-metallic materials, such as polyurethane, tungsten loaded urethanes.

Figure 9:
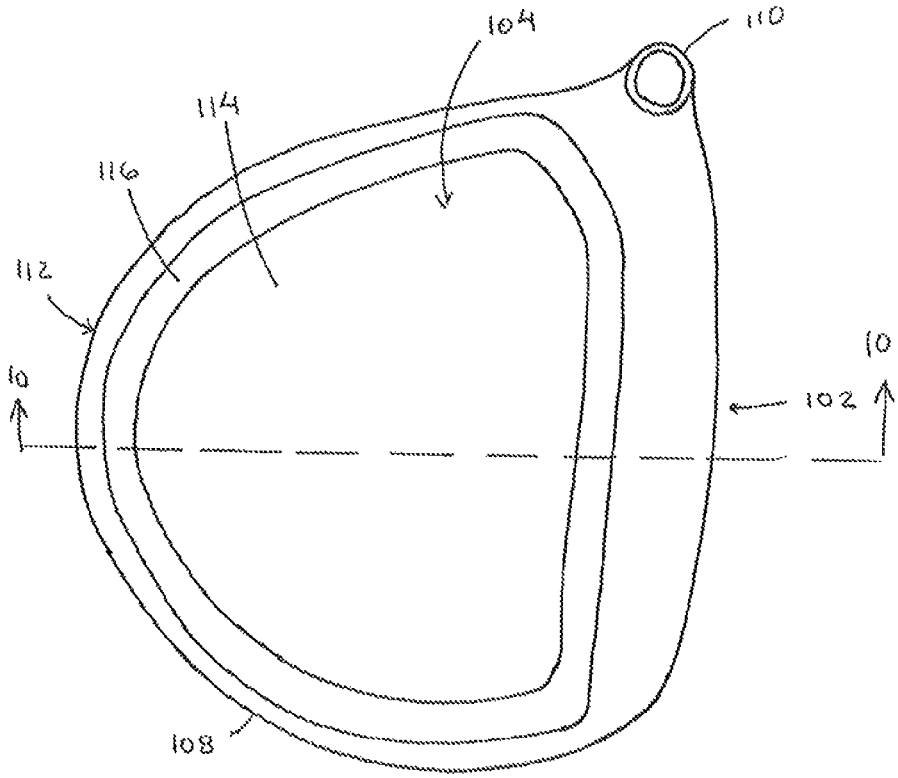
FIG. 9 is a top view of another embodiment of a golf club head of the present invention.
Figure 10:
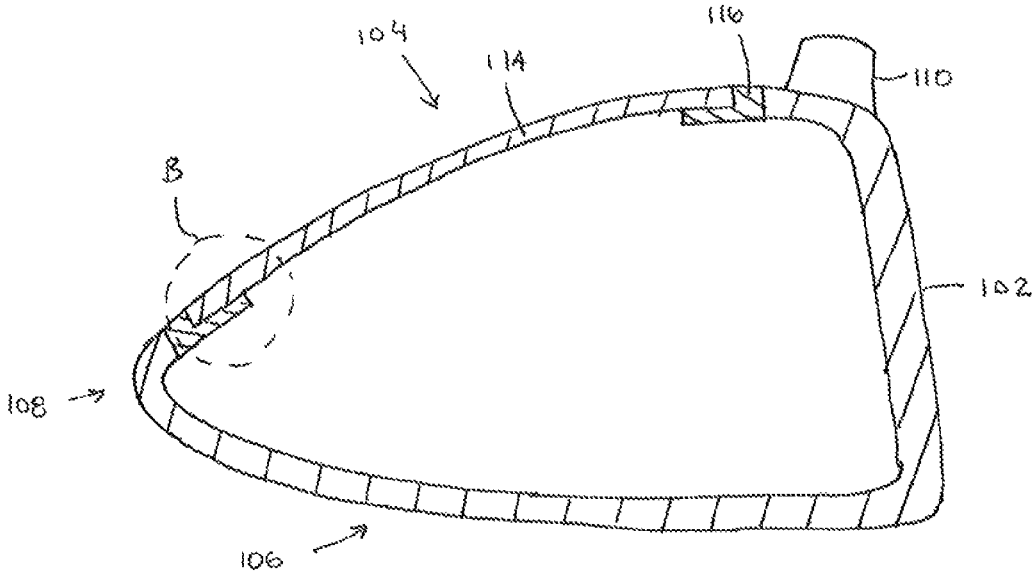
FIG. 10 is a cross-sectional view, taken along line 10-10, of the golf club head of FIG. 9.
Figure 11:
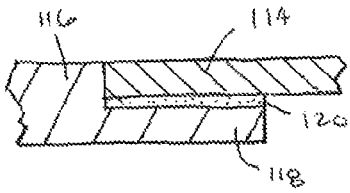
FIGS. 11-17 are partial cross-sectional views of alternative embodiments of detail B, shown in FIG. 10.

Referring now to FIGS. 9-11, another embodiment of a golf club head having an improved structure will be described. Golf club head 100 generally includes a ball-striking face 102, a crown 104, a sole 106, a skirt 108 that extends between crown 104 and sole 106, and a hosel 110. In the present embodiment, crown 104 includes a multi-material construction and includes a body member 112, a coupling member 116, and a crown member 114. Body member 112 includes an opening in the crown that receives crown member 114.

Crown member 114 is coupled to body member 112 through coupling member 116. Coupling member 116 is included and constructed to simplify the manufacturing process required to couple crown member 114 to body member 112, especially when a non-metallic crown member 114 is coupled to a metallic body member 112. For example, a composite crown member 114 may be coupled to coupling member 116, such as by adhesive bonding, and excess adhesive may be removed before the combined crown member 114 and coupling member 116 is secured to body member 112. As a result, excess adhesive that would otherwise add additional weight to the assembled golf club may be removed. Additionally, a more difficult coupling process and/or configuration may be utilized to couple crown member 114 and coupling member 116 when the two are separate from body member 112, where they may be fixtured and manipulated more easily. Alternatively, coupling member 116 and crown member may be co-molded.

Preferably, the material of coupling member 116 is selected to provide improved bonding strength between it and the material of body member 112 so that the overlapping bonding surfaces can be minimized to avoid adding unnecessary mass and to improve the integrity of the joint. For example, when a metallic body member 112 and a generally non-metallic crown member 114 are coupled, the crown member preferably includes a multi-material construction so at least the bonding portion provides a material high surface free energy because non-metal materials generally do not have very high surface free energy. For example, material having high surface energy, such as a metallic material like metallic mesh, may be added to the crown member to improve the efficiency of the bond. For example, including titanium mesh in a portion of the crown member may be used to increase efficiency during bonding of that component to a titanium body member. Ideally, the surface free energy of the members being bonded is greater than the surface tension of the bonding material so that the bonding material wets the bonding surfaces to provide a strong bond.

Additionally, forming the bond between the components separate from the club head body member may also be used to improve efficiency of the bonding because preparation of the bonding surfaces, post bonding processes and control over the fit of the components may be improved. For example, properly cleaning the bonding surfaces is important to maintain the surface energy of the material as high as possible. Methods of raising, and maintaining, the surface free energy of thermoset composites include abrasion using an abrasive material, such as an abrasive pad (e.g., Scotch-Brite pads, a registered trademark of 3M Company, St. Paul, Minn.) or sand paper, and grit blasting, then removing dust and debris using solvent wipes or dry wipes. Methods for maintaining high free surface energy for metal materials include vapor or solvent degreasing, increasing the effective bonding surface area by chemical or acid etching, use of a chemical coupler surface treatment such as a sol-gel process, and use of a corrosion inhibiting primer to preserve the freshly treated surface. By improving the efficiency of the bonding the overall bond width may be reduced, especially in the side joints. The coupling member is preferably constructed from a material that is the same as the body member or weldable to the body member.

As shown in FIGS. 10 and 11, crown member 114 may be coupled to coupling member 116 with a lap joint. The lap joint is created by a flange 118 included on coupling member 116 and an overlapping portion of crown member 114 that is coupled thereto. For example, the two members may be coupled using a bonding material 120, such as by adhesive bonding, brazing, or soldering the two components together. Where the materials of crown member 114 and coupling member 116 permit welding, the bonding material 120 may be weld material.

Figure 12:
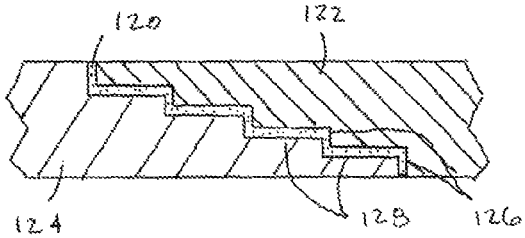
Figure 15:
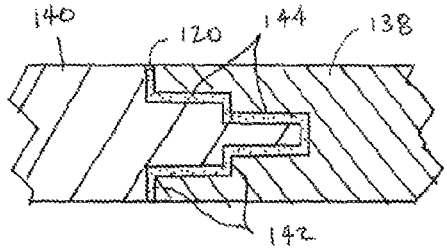
Figure 13:
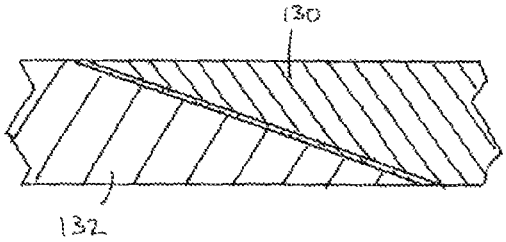
Figure 16:
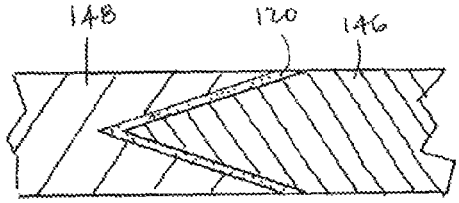

Referring to FIGS. 12-17, alternative coupling configurations between a crown member, a coupling member and a body member will be described. FIG. 12 illustrates a lap joint and FIG. 13 illustrates a tapered scarf joint that may be employed. For example, in FIG. 12, a crown member 122 and a coupling member 124 have complementary stepped flanges that are coupled with bonding material 120. The stepped flanges are formed by a plurality of shoulders 126 and landings 128 and although shoulders 126 and landings 128 are shown perpendicular to each other, it should be appreciated that they may have any angle relative to each other. For example, shoulders 126 and landings 128 may be oriented to generally form a sawtooth pattern. Another lap joint, illustrated in FIG. 13, includes an angled interface between a crown member 130 and a coupling member 132. The angle of the interface between the components may be selected so that a desired distribution of shear and normal forced may be placed on bonding material 120 for a predetermined force on the components.

Figure 14:
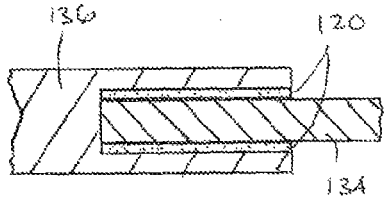

In other embodiments of coupling configurations, the components are configured so that a portion of one component is received in a portion of the other component. As a result, the components are coupled by bonding material 120 and a mechanical connection. Referring to FIG. 14, a portion of a crown member 134 is inserted into a recess of a coupling member 136 and a pair of parallel interfaces are coupled by bonding material 120. In another embodiment, shown in FIG. 15, a crown member 138 includes a recess that receives a portion of a coupling member 140. Crown member 138 and coupling member also engage at a stepped interface that includes a plurality of shoulders 142 and landings 144. Bonding material 120 is disposed at the stepped interface to securely couple the components. In a still further embodiment, shown in FIG. 16, a portion of a crown member 146 is received in a recess of a coupling member 148 and the two components engage at a pair of angled interfaces that are also held together with bonding material 120. In such embodiments, the components may be coupled using thermal fitting techniques. For example, the coupling member may be heated and/or the crown member may be cooled so that clearance is provided between the components when the temperatures are different, then the components may be held in place until their temperatures are equalized. The materials may be selected, at least in part, by considering the required expansion based on the coefficient of thermal expansion of the material.

Figure 17:
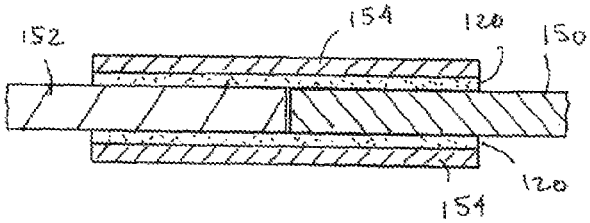

Referring to FIG. 17, illustrates a strap lap joint that includes a crown member 150 that is attached to a coupling member 152 by a pair of support members 154. In particular, end surfaces of crown member 150 and coupling member 152 abut and support members 154 are coupled across the abutment to the side surfaces of crown member 150 and coupling member 152.

It should further be appreciated that the club head construction including a coupling member to couple the body member and another component may be applied in other portions of the golf club head. For example, a coupling member may be used to couple a crown member (as shown), a sole member, a face member, and/or a hosel member to a body member of the golf club head.

While it is apparent that the illustrative embodiments of the invention disclosed herein fulfill the objectives stated above, it is appreciated that numerous modifications and other embodiments may be devised by those skilled in the art. Elements from one embodiment can be incorporated into other embodiments. Therefore, it will be understood that the appended claims are intended to cover all such modifications and embodiments, which would come within the spirit and scope of the present invention.

We claim:

1. A golf club head, comprising:

a body member including a crown portion, a sole portion, a face portion and a discontinuous skirt portion such that the skirt portion defines a gap, wherein the skirt portion extends aft-ward from at least one of a heel and toe ends of the body member;

a sole member coupled to the sole portion and the skirt portion such that a portion of the sole member is inserted into the gap to make the skirt continuous; and a crown member coupled to the body member and the sole member.

2. The golf club head of claim 1, wherein the skirt portion includes a toe skirt portion.

3. The golf club head of claim 1, wherein the skirt portion includes a heel skirt portion.

4. The golf club head of claim 1, wherein the gap is disposed at an aft portion of the golf club head.

5. The golf club head of claim 1, wherein the portion of the sole member inserted into the gap includes a flange.

6. The golf club head of claim 5, wherein the flange has a cross-sectional shape that matches a cross-sectional shape of the adjacent skirt portion.

* * * * *